US010704125B2

(12) United States Patent
Schiess et al.

(10) Patent No.: US 10,704,125 B2
(45) Date of Patent: Jul. 7, 2020

(54) FREE-MACHINING POWDER METALLURGY STEEL ARTICLES AND METHOD OF MAKING SAME

(71) Applicants: CRS Holdings, Inc., Wilmington, DE (US); Olivier Schiess, Berne (CH); Pierre Marechal, Rheinfelden (CH)

(72) Inventors: Olivier Schiess, Berne (CH); Pierre Marechal, Rheinfelden (CH); Gregory J. Del Corso, Reading, PA (US); Alberto Polar-Rosas, Reading, PA (US)

(73) Assignee: CRS HOLDINGS, INC., Wilmington, DE (US)

( * ) Notice: Subject to any disclaimer, the term of this patent is extended or adjusted under 35 U.S.C. 154(b) by 483 days.

(21) Appl. No.: 15/346,885

(22) Filed: Nov. 9, 2016

(65) Prior Publication Data

US 2017/0130306 A1 May 11, 2017

Related U.S. Application Data

(60) Provisional application No. 62/252,671, filed on Nov. 9, 2015.

(51) Int. Cl.
*B22F 3/24* (2006.01)
*B22F 3/15* (2006.01)
(Continued)

(52) U.S. Cl.
CPC ..... *C22C 38/46* (2013.01); *B22F 3/15* (2013.01); *B22F 3/24* (2013.01); *B22F 5/12* (2013.01);
(Continued)

(58) Field of Classification Search
None
See application file for complete search history.

(56) References Cited

U.S. PATENT DOCUMENTS 2,789,069 A 4/1957 Nachtman
3,567,435 A 3/1971 Monnot
(Continued)

FOREIGN PATENT DOCUMENTS

JP 7188847 7/1995
JP 9176787 7/1997
(Continued)

OTHER PUBLICATIONS

English translation of JPH07-188847, EPO, accessed Aug. 14, 2019.*
(Continued)

*Primary Examiner* — Xiaobei Wang
(74) *Attorney, Agent, or Firm* — Dann, Dorfman, Herrell and Skillman, P.C.

(57) ABSTRACT

A method of making a small diameter elongated steel article such as wire or strip is disclosed. The method includes the step of melting a steel alloy having the following weight percent composition

| | |
|---|---|
| C | 0.88-1.00 |
| Mn | 0.20-0.80 |
| Si | 0.50 max. |
| P | 0.050 max. |
| S | 0.010-0.100 |
| Cr | 0.15-0.90 |
| Ni | 0.10-0.50 |
| Mo | 0.25 max. |
| Cu | 0.08-0.23 |
| V | 0.025-0.15 |
| N | 0.060 max. |
| O | 0.040 max. |

and the balance is iron and usual impurities. The method includes melting the alloy, atomizing the molten alloy to make a pre-alloyed metal powder, consolidating the metal
(Continued)

powder to substantially full density, and then hot working the consolidated metal powder to form an intermediate elongated article. The method further includes a multi-step heat treating process. A small diameter, elongated steel article having enhanced machinability is also disclosed.

11 Claims, 4 Drawing Sheets

(51) Int. Cl.

| | |
|---|---|
| ***B22F 5/12*** | (2006.01) |
| ***B22F 9/06*** | (2006.01) |
| ***C21D 9/52*** | (2006.01) |
| ***C21D 8/06*** | (2006.01) |
| ***C21D 6/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/18*** | (2006.01) |
| ***C22C 38/24*** | (2006.01) |
| ***C22C 38/40*** | (2006.01) |
| ***C22C 38/16*** | (2006.01) |
| ***C22C 38/42*** | (2006.01) |
| ***C22C 38/60*** | (2006.01) |
| ***C22C 38/22*** | (2006.01) |
| ***C22C 38/44*** | (2006.01) |
| ***C22C 33/02*** | (2006.01) |
| ***C22C 38/46*** | (2006.01) |
| ***C21D 1/32*** | (2006.01) |
| ***B22F 9/08*** | (2006.01) |
| ***C22C 38/00*** | (2006.01) |

(52) U.S. Cl.

CPC ..... *B22F 9/082* (2013.01); *C21D 1/32* (2013.01); *C21D 6/004* (2013.01); *C21D 6/005* (2013.01); *C21D 6/008* (2013.01); *C21D 8/065* (2013.01); *C21D 9/525* (2013.01); *C22C 33/0264* (2013.01); *C22C 38/001* (2013.01); *C22C 38/002* (2013.01); *C22C 38/02* (2013.01); *C22C 38/04* (2013.01); *C22C 38/40* (2013.01); *C22C 38/42* (2013.01); *C22C 38/44* (2013.01); *C22C 38/60* (2013.01); *B22F 2003/248* (2013.01); *B22F 2009/0824* (2013.01); *B22F 2009/0848* (2013.01); *B22F 2301/35* (2013.01); *B22F 2998/10* (2013.01); *C21D 2211/002* (2013.01); *C21D 2211/003* (2013.01); *C21D 2211/005* (2013.01); *C21D 2211/008* (2013.01)

(56) References Cited

U.S. PATENT DOCUMENTS

| | | | | |
|---|---|---|---|---|
| 4,249,945 | A | 2/1981 | Haswell et al. | |
| 4,581,202 | A | 4/1986 | Kudo et al. | |
| 5,989,490 | A | 11/1999 | Pinnow et al. | |
| 6,238,455 | B1 | 5/2001 | Brown et al. | |
| 6,797,031 | B1 | 9/2004 | Engstrom | |
| 8,282,701 | B2 * | 10/2012 | Schiess ..... | B22F 5/12 75/231 |
| 8,540,934 | B2 | 9/2013 | Sandstrom et al. | |
| 2003/0066577 | A1 | 4/2003 | Ishida et al. | |
| 2010/0068547 | A1 * | 3/2010 | Schiess ..... | B22F 5/12 428/546 |
| 2012/0321500 | A1 | 12/2012 | Schiess et al. | |

FOREIGN PATENT DOCUMENTS

| | | |
|---|---|---|
| WO | 0129274 | 4/2001 |
| WO | 0131076 | 5/2001 |
| WO | 2007120110 | 10/2007 |
| WO | 2010029505 | 3/2010 |

OTHER PUBLICATIONS

Sandvik Technical Data Sheet, Sandvik Finemac free-cutting wire, Oct. 20, 2014, pp. 1-7.

PCT/US2009/056661, Written Opinion of the International Searching Authority, dated Jun. 2, 2010, pp. 1-10.

* cited by examiner

FREE-MACHINING POWDER METALLURGY STEEL ARTICLES AND METHOD OF MAKING SAME

CROSS REFERENCE TO RELATED APPLICATIONS

This application claims the benefit of U.S. Provisional Patent Application No. 62/252,671, filed Nov. 9, 2015, the entirety of which is incorporated herein by reference.

BACKGROUND OF THE INVENTION

Field of the Invention

This invention relates generally to a free-machining steel article and to a method for making same. More particularly, the invention relates to elongated product forms such as wire, rod, bar, band, and strip made from a substantially lead-free, free-machining, powder metallurgy steel.

Description of Related Art

Small, precision-machined parts for the watch, automotive, and other industries are made from steel wire that has been cold drawn and then straightened. Good machinability is required for manufacturing such parts and is usually obtained by including in the structure of the steel one or more additives to enhance the machinability property. Pb, S, and Se are among the most common additions to steel for enhancing machinability. However, the addition of Pb has some safety issues. Therefore, a lead-free machining steel with the same or better machinability than leaded steel is desired.

U.S. Pat. No. 8,282,701 B2 and U.S. Pat. No. 8,795,584 B2, describe a lead-free, free-machining steel article for use in the production of high quality, precision parts and a process for making such an article. The microstructure of the steel described in those patents is fine grained and has a fine and uniform distribution of manganese sulfides (MnS). As described in those patents, the microstructure is obtained by using a controlled alloy chemistry, gas atomization to produce alloy powder, followed by hot consolidation of the alloy powder to form a powder compact. A billet is prepared from the powder compact which is then hot worked and cold finished to make wire and bar products for machining into small precision parts.

The alloy and method described in U.S. Pat. No. 8,282,701 B2 and U.S. Pat. No. 8,795,584 B2 has been used to provide small diameter wire and bar with acceptable machining characteristics for making small, precision parts. However, it has been determined in practice that better machinability is needed for the machining of very small precision parts. Accordingly, it is an object of the current invention to provide small diameter wire and bar products that have a finer and more homogenous distribution of carbides to thereby enhance machinability and processability of the wire or bar beyond what was previously achievable with the material made in accordance with U.S. Pat. No. 8,282,701 B2 and U.S. Pat. No. 8,795,584 B2. An additional object of the present invention is to provide a process for making very small diameter wire and bar, including a heat treatment that, in combination with the modified chemistry, will readily provide the desired microstructure in order to obtain the enhanced combination of properties described above. The entire disclosures of U.S. Pat. No. 8,282,701 B2 and U.S. Pat. No. 8,795,584 B2 are hereby incorporated herein by reference.

BRIEF SUMMARY OF THE INVENTION

In accordance with one aspect of this invention, there is provided an elongated article having a small cross-sectional area such as wire, rod, bar, and strip. The elongated article is made from a prealloyed metal powder having the following broad and preferred weight percent compositions.

| Element | Broad | Preferred |
|---|---|---|
| C | 0.88-1.00 | 0.92-0.98 |
| Mn | 0.20-0.80 | 0.20-0.80 |
| Si | 0.50 max. | 0.12-0.22 |
| P | 0.050 max. | 0.030 max. |
| S | 0.010-0.100 | 0.010-0.090 |
| Cr | 0.15-0.90 | 0.30-0.60 |
| Ni | 0.10-0.50 | 0.10-0.25 |
| Mo | 0.25 max. | 0.25 max. |
| Cu | 0.08-0.23 | 0.10-0.23 |
| V | 0.025-0.15 | 0.035-0.060 |
| N | 0.060 max. | 0.060 max. |
| O | 0.040 max. | 0.040 max. |

The balance of the alloy is iron and usual impurities. The wire and bars according to this aspect of the invention are further characterized by a microstructure that includes i) a ferritic matrix having uniform, fine grain size, preferably defined by an ASTM E-112 grain size number of 8 or greater, ii) a uniform distribution of manganese sulfides that are not larger than about 2 μm in major dimension uniformly distributed in said matrix, and iii) a uniform dispersion of fine, spheroidal carbides that are not larger than about 4 μm in major dimension uniformly distributed in said matrix.

In accordance with another aspect of the present invention, there is provided a method of making a small diameter, elongated article, such a wire, bar, or strip, having machinability that is superior to the known materials. In a first step of the method of this invention, a steel alloy having the following weight percent composition is melted in a melting furnace:

| | |
|---|---|
| C | 0.88-1.00 |
| Mn | 0.20-0.80 |
| Si | 0.50 max. |
| P | 0.050 max. |
| S | 0.010-0.100 |
| Cr | 0.15-0.90 |
| Ni | 0.10-0.50 |
| Mo | 0.25 max. |
| Cu | 0.08-0.23 |
| V | 0.025-0.15 |
| N | 0.060 max. |
| O | 0.040 max. |
| Fe and Impurities | Balance |

The method comprises the further steps of atomizing the steel alloy with an inert gas to form a prealloyed steel powder and consolidating the steel powder to substantially full density to form a powder compact. The powder compact is hot worked to form an elongated intermediate article. The method also includes heat treating the intermediate article by performing the following steps: a) heating the intermediate article at a first temperature of about 40 C.° below to about 25 C.° above the alloy's $A_{cm}$ temperature for about 45-90 minutes per inch of thickness of the intermediate article; b) cooling the intermediate article from the first temperature at a rate sufficient to transform the alloy to one or more of martensite, upper bainite, lower bainite, and combinations thereof in said intermediate article; c) heating the intermediate article at a second temperature of about 150 C.° below the alloy's $A_1$ temperature to the $A_1$ temperature for a time sufficient to precipitate a plurality of fine carbides in the matrix material of the alloy; d) cooling the reheated intermediate article in air from the second temperature to room temperature; e) heating the intermediate article at a third temperature of about 10-50 C.° above the alloy's $A_1$ temperature for about 1.5-6 hours per inch of thickness; f) cooling the intermediate article from the third temperature at a rate of about 5-80 C.°/hour to an intermediate temperature of about 100-400 C.° below the $A_1$ temperature; and then g) air cooling the intermediate article from the intermediate temperature to room temperature. The heat treated article is then further processed to reduce its cross-sectional area to provide an elongated article having a small cross section or diameter such as wire, rod, strip or bar for precision machining of parts. The further processing may include cold drawing and/or cold rolling. The cold drawing and cold rolling steps may be accomplished in one or more steps to reach the final dimensions.

In accordance with another embodiment of the process according to this invention the powder compact may be hot worked as by hot rolling to provide an elongated article such as wire, rod, or band having final or near-final dimensions. The hot rolled article is then heat treated as described in steps a) to g) above.

Here and throughout this application the following terms are defined as follows. The term "percent" and the symbol "%" mean percent by weight or mass percent unless otherwise indicated. Upper bainite is defined in accordance with its known definition as an aggregate of ferrite and cementite that contains substantially parallel lath-shaped elements of ferrite. Lower bainite is defined in accordance with its known definition as an aggregate of ferrite and cementite that has an acicular appearance. Ferrite and cementite are known phases of steel. The $A_{cm}$ temperature is defined in accordance with its known definition as the temperature below which cementite starts forming in steel during cooling. The $A_1$ temperature is defined in accordance with its known definition as the temperature at which the austenite phase of steel transforms to a eutectoid comprising pearlite. The term "small diameter" refers to a product form having a round cross section and is defined to mean a diameter of not more than about 1.725 inches (43.81 mm). The terms "thin" and "small thickness" are defined to mean a thickness of not more than about 3 mm.

BRIEF DESCRIPTION OF THE DRAWINGS

The foregoing summary and the following detailed description will be better understood when read with reference to the drawings, wherein.

DETAILED DESCRIPTION OF THE INVENTION

Figure 1:
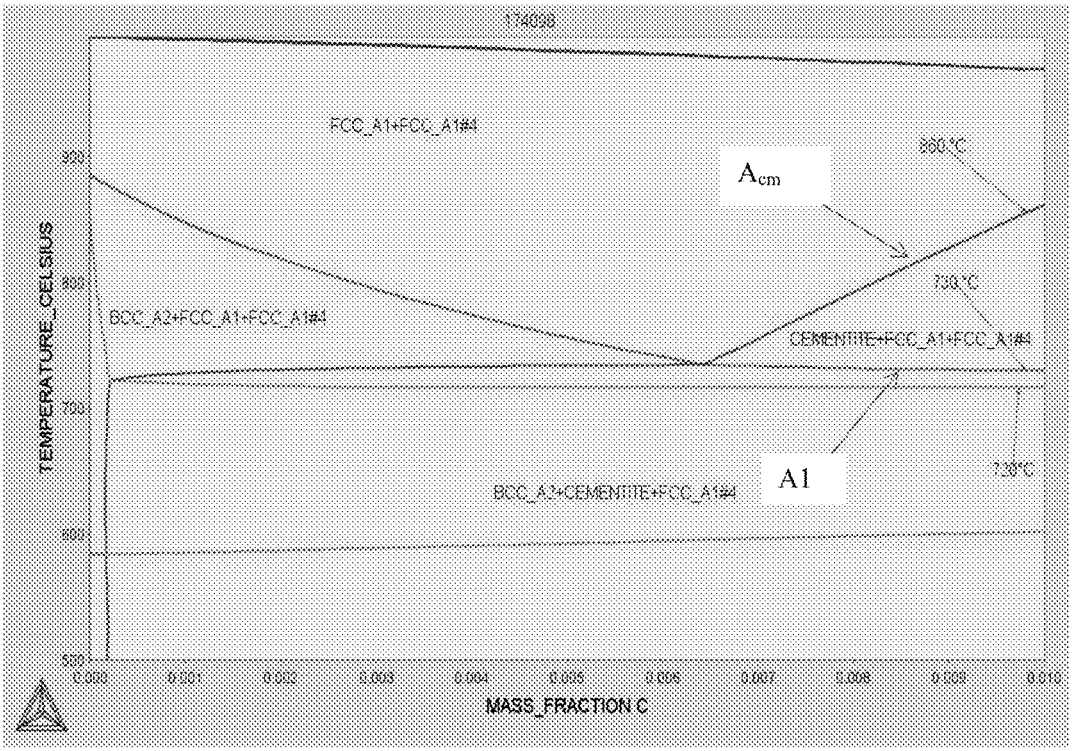
FIG. 1 is an alloy phase diagram for Heat 098 described in the Working Examples section of this application.

For the purposes of this application the elemental weight percent ranges described above are balanced to provide a microstructure comprising a ferritic matrix containing very fine and uniformly distributed, spheroidized carbides that provide better machinability during low speed and high speed cutting of the metal than the known materials. Based on the desired properties the following elemental ranges are selected for the alloy composition according to this invention.

Carbon is an austenite stabilizer and an element that forms carbides with other elements present in the alloy of this invention. About 0.88-1.00% carbon should be present in the alloy for the broad aspect of this invention and preferably about 0.92-0.98% carbon is be present.

Manganese is also an austenite stabilizer and may cause modification of the $A_1$ temperature of the alloy when combined with other elements. Manganese combines with available sulfur to form manganese sulfides that are beneficial to the excellent machinability provided by this alloy. For these reasons the alloy contains about 0.20-0.80% manganese.

Silicon is a ferrite stabilizer and may also be present in this alloy as a residual from deoxidizing additions during melting of the alloy. The alloy contains up to about 0.50% and preferably contains about 0.12-0.22% silicon.

Sulfur combines with manganese to form manganese sulfides that are needed for good machinability. The alloy is processed in a way that results in fine, dispersed sulfides. For these reasons the alloy contains about 0.010-0.100% and preferably about 0.010-0.090% sulfur.

Chromium is a strong carbide former and also imparts some corrosion resistance to the alloy. Chromium is considered necessary in the alloy of this invention to form the fine carbides that provide sites that function as nuclei for the precipitation and growth of substantially spherical carbides instead of lamellar-shaped carbides during the spheroidization process. However, too much chromium will cause the $A_{cm}$ temperature to increase which leads to stabilization of large and coarse primary carbides that are difficult to dissolve during heat treatment. Also, chromium increases the hardenability of the steel which raises the likelihood of cracking when the alloy is subsequently heat treated as described below. In view of the foregoing, the alloy contains about 0.15-0.90% chromium and preferably the alloy contains about 0.30-0.60% chromium.

Nickel is an austenite stabilizer and also benefits the hardenability of the steel without significantly raising the $A_{cm}$ temperature. For these reasons the alloy contains about 0.10-0.50% nickel and preferably contains about 0.10-0.25% nickel.

A small amount of molybdenum may be present in this alloy as a residual from charge materials used during melting. Molybdenum is also a strong carbide former and would help with the production of primary fine carbides as a substitute for at least some of the vanadium. Accordingly, up to about 0.25% molybdenum may be present in this alloy for either of the foregoing reasons.

Copper is also an austenite stabilizer. Copper combines with sulfur to form sulfides that are beneficial for the machinability provided by the alloy. Copper may also provide some corrosion resistance in the alloy. However, the use of copper is restricted to levels that do not result in incipient melting in the alloy during processing and heat treatment. Accordingly, the alloy contains about 0.08-0.23% and preferably about 0.10-0.23% copper.

A small amount of vanadium is present in the alloy to aid in the production of primary, fine, and stable MC-type carbides that contribute to breaking up of carbide lamella to form more spherical carbides. For these reasons the alloy of the present invention contains about 0.025-0.15% vanadium and preferably contains about 0.035-0.060% vanadium.

Nitrogen may be present in the alloy primarily as a result of adsorption when the alloy is atomized with nitrogen gas.

Nitrogen is preferably restricted to a maximum of about 0.060% (600 ppm) in the alloy powder according to the present invention.

The balance of the alloy is iron and the usual impurities found in alloys used for the same or similar purposes. In particular, phosphorus is considered an impurity in this alloy and should be limited to not more than about 0.050% and preferably to not more than about 0.030%. Oxygen is also considered an impurity in the alloy powder of this invention and is preferably limited to not more than about 0.040%.

The method of making a small diameter elongated steel article with good machinability and stability includes the following process steps. The alloy is melted in a melting furnace preferably by vacuum melting. The molten alloy is atomized with an inert gas to form a pre-alloyed powder having the weight percent composition described above. The inert gas may be nitrogen, argon, or a combination thereof. Preferably, the metal powder is produced by atomization with nitrogen gas in an induction melting and gas atomization unit. The atomized powder is preferably screened to about −100 mesh and may be blended with one or more other heats having essentially the same alloy composition to produce a blended metal powder. The alloy powder is vibration filled into a low carbon steel canister. The powder-filled canister is then vacuum hot outgassed and sealed. Hot outgassing is described, for example, in U.S. Pat. No. 4,891,080, the entirety of which is incorporated herein by reference. The sealed canister is then hot isostatically pressed (HIP) preferably at about 1121° C. and 15 ksi for a time sufficient to fully densify the metal powder. Argon gas is preferred as the pressurizing fluid. After HIP the fully dense metal powder is hot rolled from a temperature of about 1149° C. to form an elongated intermediate form such as a billet that includes the consolidated metal powder and a cladding consisting of the low carbon steel alloy of the canister.

The elongated intermediate form is heat treated using a three-step process which includes one or more operations comprising time and temperature conditions selected to produce a general microstructure containing fine, dispersed, spheroidized carbides and fine sulfides in a ferrite matrix. In another embodiment of the process of this invention, the billet or other intermediate form is hot worked, such as by hot rolling, to provide bar, wire, rod, strip, or band having final or near-final dimensions and then given the three-step heat treatment to provide the desired microstructure.

The heat treatment used in the method according to this invention is further described as follows. In a first heating step, the intermediate article is heated at a temperature of about 40 C.° below the $A_{cm}$ temperature of the alloy to about 25 C.° above the $A_{cm}$ temperature. The $A_{cm}$ temperature boundary for this alloy is shown by the upper arrow in FIG. 1. The $A_{cm}$ temperature for a preferred composition of the alloy used in this invention is calculated to be 860° C. Preferably the elongated intermediate article is heated at a temperature of about 20 C.° below the $A_{cm}$ temperature of the alloy to about 5 C.° above the $A_{cm}$. The first heating step is conducted for about 45 to 90 minutes per inch of diameter or thickness. The time and temperature parameters of first heating step are selected to cause dissolution of lamellar and primary carbides that form during the hot working and cooling of the consolidated intermediate article. The first heating step develops a microstructure that comprises preferably 100% austenite and is stable at the $A_{cm}$ temperature of the alloy.

The first heating step is followed by rapid cooling in an appropriate media such as inert gas or a liquid quench (e.g., oil quenching) to cause transformation of the stabilized austenite to a lower temperature microstructure, like martensite, lower bainite, upper bainite, or a combination thereof. The cooling rate is selected to be high enough to avoid the formation of pearlite in the alloy, but low enough to avoid cracking because the alloy contains relatively high carbon and a relatively small number of alloying elements that benefit the hardenability of the alloy. Accordingly, after the first heating step the intermediate article is cooled at a rate of about 20-60 C.°/sec. from the $A_{cm}$ temperature to room temperature.

An alternative method to transform the austenite to martensite, lower bainite, and/or upper bainite as an intermediate microstructure includes isothermal transformation of austenite at temperatures above the martensite transformation start temperature ($M_s$) until complete, followed by cooling in a gas or liquid medium. The $M_s$ temperature for the preferred chemistry of the alloy according to the present invention was calculated to be 140° C.±15 C.°.

The heat treatment is continued with a second heating step in which the elongated article is heated at a second temperature of about 150 C.° below the $A_1$ temperature up to the $A_1$ temperature. Preferably, the elongated article is heated at a temperature that is about 120 to 80 C.° below the $A_1$ temperature. The $A_1$ temperature calculated for a preferred chemistry of this alloy is about 720-730° C. The $A_1$ temperature boundary is identified by the lower arrow shown in FIG. 1. This second heating step is designed to facilitate the precipitation of fine and well dispersed carbides along the martensite or bainite laths and also along the grain boundaries.

In a further heating step the article is heated at a third temperature that is about 10 to 50 C.° above the $A_1$ temperature, preferably at about 15 to 35 C.° above $A_1$ for about 90 to 360 minutes (1.5-6 h) per inch of thickness and preferably for about 90 to 120 min (1.5-2 h) per inch of thickness. The article is then cooled at a cooling rate of about 5 to 80 C.°/hr and preferably at a cooling rate of about 15 to 35 C.°/hr to a temperature of about 100 to 400 C.° below the $A_1$ temperature. The article is then air cooled to room temperature.

After heat treatment, the elongated intermediate article may undergo one or more cycles of cold drawing, each cold reduction step followed by stress relief annealing, until the desired diameter is obtained. The cold-drawn material is typically provided as wire with a diameter of about 1.75 mm, 3 mm, 4.5 mm, or 6.5 mm. Larger diameter wire can also be produced to provide small diameter finished bar up to about 15 mm in diameter. As an alternative process, the elongated intermediate article may be cold rolled after the heat treatment to provide strip.

Working Examples

In order to demonstrate the improved microstructure provided in the article and by the method according to the present invention three experimental heats were melted and atomized to produce prealloyed metal powder. The weight percent compositions of the experimental heats are shown in the table below.

| Element | Heat 098 | Heat 223 | Heat 560 |
|---|---|---|---|
| C | 0.95 | 0.97 | 0.94 |
| Mn | 0.51 | 0.49 | 0.46 |
| Si | 0.18 | 0.2 | 0.18 |

-continued

| Element | Heat 098 | Heat 223 | Heat 560 |
|---|---|---|---|
| S | 0.06 | 0.06 | 0.053 |
| Cr | 0.51 | 0.43 | <0.1 |
| Ni | 0.18 | 0.2 | <0.1 |
| Cu | 0.22 | 0.21 | <0.1 |
| V | 0.058 | 0.058 | |
| N | 0.004 | 0.005 | <0.02 |
| O | 0.023 | 0.014 | |

The balance of each composition was iron and usual impurities, including <0.030% P.

Heats 098 and 223 have weight percent compositions that embody the alloy according to the present invention. Heat 560 embodies the alloy described in U.S. Pat. No. 8,282,701 B2 and U.S. Pat. No. 8,795,584 B2. The experimental heats were vacuum induction melted and then atomized with nitrogen gas to form pre-alloyed metal powder. The metal powder from each heat was screened to −100 mesh and then filled into a low carbon steel canister. The powder filled canisters were vacuum hot outgassed and then sealed.

The powder filled canisters were then hot isostatically pressed (HIP'd) at 1121° C. at a pressure of 15 ksi for a time sufficient to provide substantially fully dense powder compacts. The powder compacts were then hot rolled to form billets consisting of the consolidated metal powder and a cladding formed from the canister. The billets were further hot rolled to an elongated intermediate form and then air cooled to room temperature.

The intermediate elongated forms of Heats 098 and 223 were heat treated as follows. The elongated forms were austenitized by heating at 850° C. for one hour and then quenched in oil. After quenching, the elongated intermediate forms were tempered by heating at 620° C. for 4 hours and then air cooled. The elongated forms were then re-austenitized by heating at 750° C. for 2 hours, furnace cooled at 20 C.° per hour down to 580° C., and then air cooled to room temperature. After the heat treatment, the elongated forms of Heats 098 and 223 were shaved to remove the carbon steel cladding and then cold drawn to a final diameter of 0.3208 inches.

The elongated intermediate form of Heat 560 was heat treated as follows. The elongated intermediate form was austenitized by heating at 738° C. for 8 hours, furnace cooled at 10 C.°/hour to 600° C., and then air cooled. After cooling, the elongated form was shaved to remove the carbon steel cladding layer and then cold drawn to a final diameter of 0.2055 inches. The wire was then re-austenitized by heating at 738° C. for 8 hours, furnace cooled from the austenitizing temperature to 600° C. at 10 C.°/hour, and cooled in air to room temperature.

Figure 2:
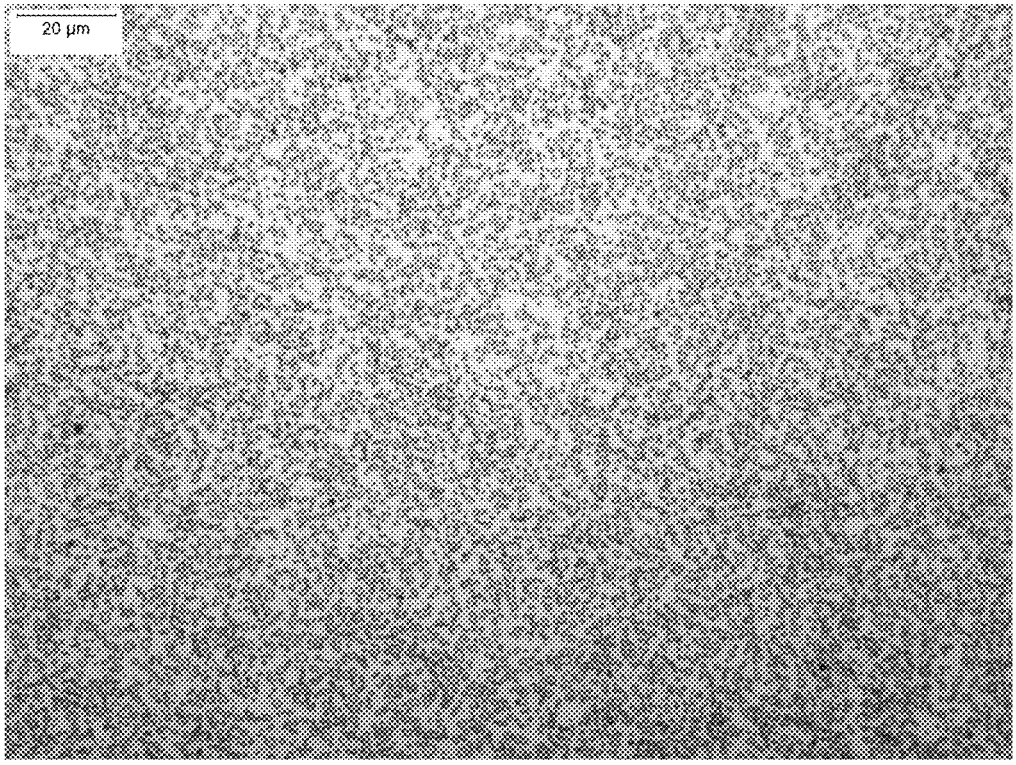
FIG. 2 is a photomicrograph of a sample of wire prepared from Heat 098.
Figure 3:
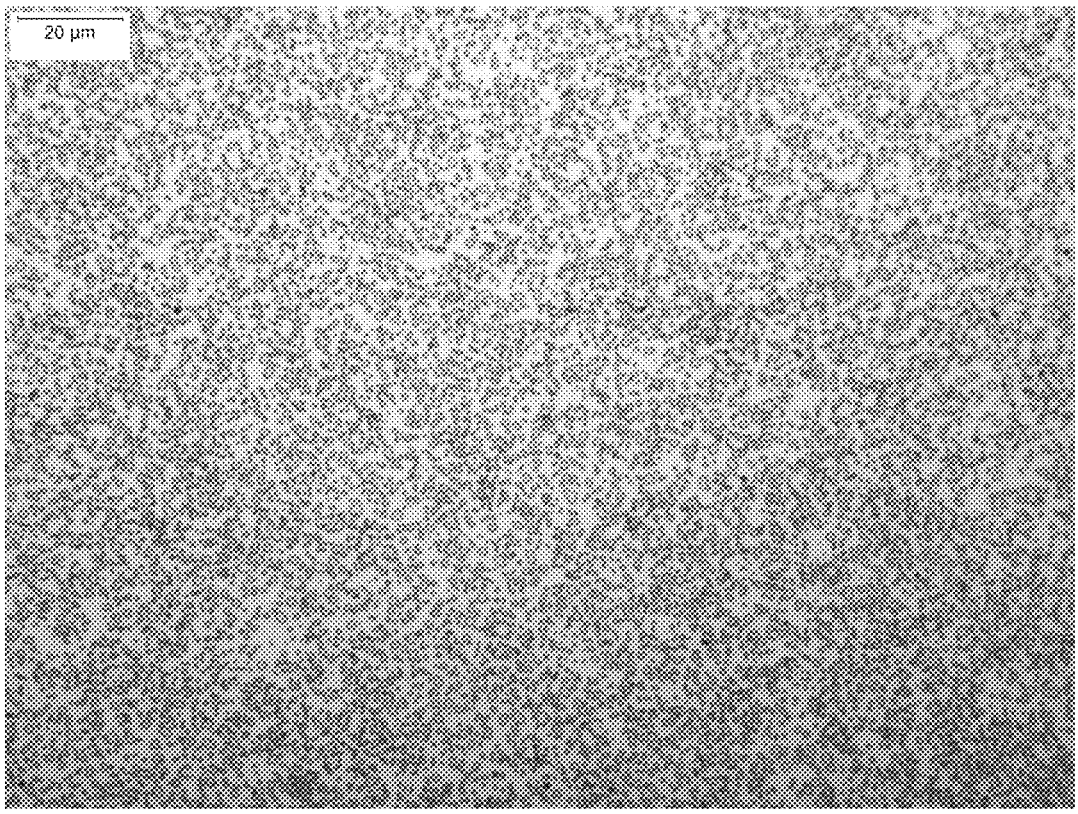
FIG. 3 is a photomicrograph of a sample of wire prepared from Heat 223 as described in the Working Examples section herein.
Figure 4:
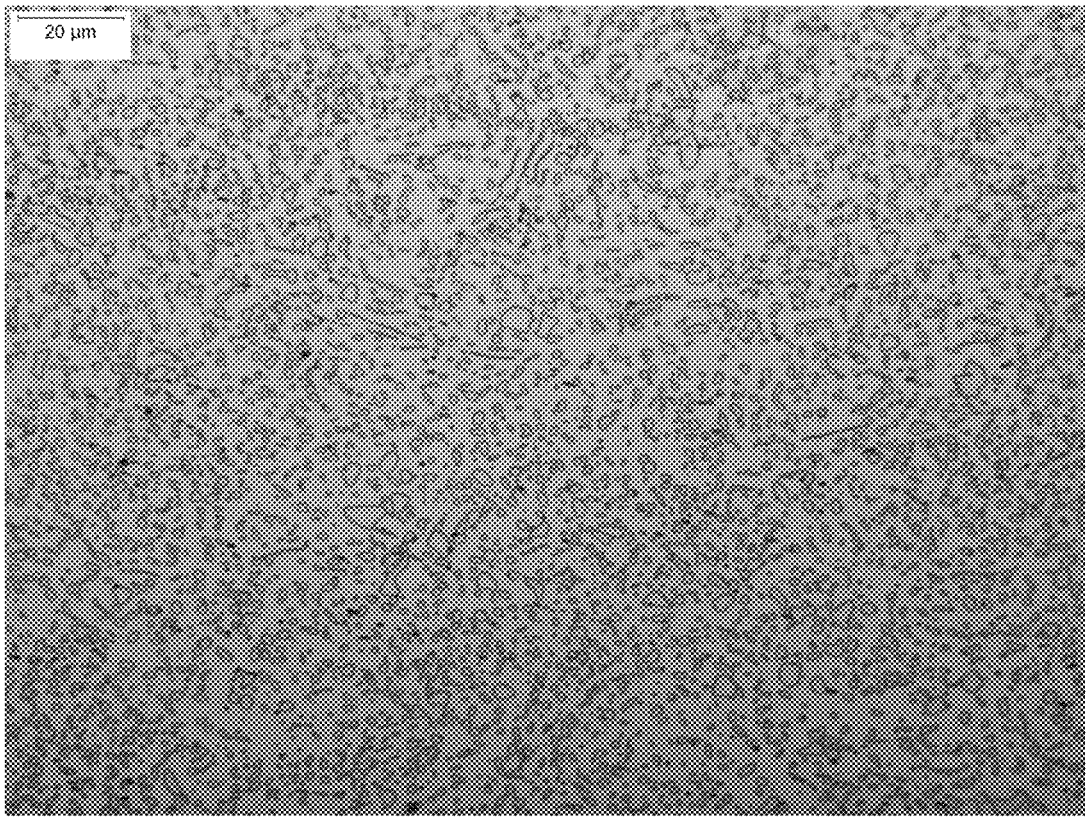
FIG. 4 is a photomicrograph of a sample of wire prepared from Heat 560 as described in the Working Examples section herein.

Longitudinal metallographic specimens were prepared from the wire produced for each of Heats 098, 223, and 560 and photomicrographed in accordance with ASTM A 892. Representative micrographs for Heats 098, 223, and 560 are shown in FIGS. 2, 3, and 4, respectively. The microstructures were evaluated using the procedure described in ASTM A 892. Based on the evaluations the microstructures of Heats 098 and 223 were rated as CS3, CN1, and LC1. The microstructure of Heat 560 was rated as CS5, CN2, and LC2. The carbide size rating CS3 for Heats 098 and 223 indicates a significantly finer (smaller) carbide size than the CS5 rating for Heat 560. The carbide network rating of CN2 indicates that Heats 098 and 223 are substantially free of carbide networks whereas the CN3 rating of Heat 560 indicates the presence of at least some carbide networks. Further, the lamellar carbide rating of LC1 indicates that Heats 098 and 223 are substantially free of lamellar carbides, whereas the rating of LC3 indicates that Heat 560 has significantly more lamellar carbides than Heats 098 and 223.

The terms and expressions which are employed herein are used as terms of description and not of limitation. There is no intention in the use of such terms and expressions of excluding any equivalents of the features shown and described or portions thereof. It is recognized that various modifications are possible within the invention described and claimed herein. Moreover, it is contemplated that the steps of the process described herein may be carried out by more than one entity. For example, the steps of melting and atomizing the alloy powder may be carried out by a first entity, the step of consolidating the alloy powder may be carried out by a second entity, and the hot-working, heat treating, and cold-working steps may be carried out by one or more other entities.

The invention claimed is:

1. A method of making a small diameter elongated steel article comprising the steps of melting a steel alloy having the following weight percent composition in a melting furnace:

| | |
|---|---|
| C | 0.88-1.00 |
| Mn | 0.20-0.80 |
| Si | 0.12-0.22 |
| P | 0.050 max. |
| S | 0.010-0.100 |
| Cr | 0.30-0.90 |
| Ni | 0.10-0.50 |
| Mo | 0.25 max. |
| Cu | 0.08-0.23 |
| V | 0.025-0.15 |
| N | 0.060 max. |
| O | 0.040 max. |

the balance being iron and usual impurities;

atomizing the steel alloy with an inert gas to form a prealloyed steel powder;

consolidating the steel powder to substantially full density to form a powder compact;

hot working the powder compact to form an elongated intermediate article;

heat treating the intermediate article by performing the following steps:

a) heating the intermediate article at a first temperature in the range from about 40° C. below to about 25° C. above the alloy's $A_{cm}$ temperature for about 45-90 minutes per inch of thickness of the intermediate article;

b) cooling the intermediate article from the first temperature at a rate sufficient to transform the alloy to one or more of martensite, upper bainite, lower bainite, and combinations thereof in said intermediate article; then c) heating the intermediate article at a second temperature in the range from about 150° C. below the alloy's $A_1$ temperature to the $A_1$ temperature for a time sufficient to precipitate a plurality of fine carbides in the matrix material of the alloy;

d) cooling the reheated intermediate article from the second temperature; then e) heating the intermediate article at a third temperature of about 10-50° C. above the alloy's $A_1$ temperature for about 1.5-6 hours per inch of thickness;

f) cooling the intermediate article from the third temperature at a rate of about 5-80° C./hour to an intermediate temperature of about 100-400° C. below the $A_1$ temperature; and then g) air cooling the intermediate article from the intermediate temperature to room temperature;

whereby the elongated steel article has a microstructure consisting essentially of:

a) a ferritic matrix having a substantially uniform distribution of fine grains characterized by a grain size number of at least about 8 as determined in accordance with ASTM Standard Specification E 112;

b) a plurality of fine carbides uniformly distributed throughout the ferritic matrix, said carbides being substantially spheroidal in shape and not greater than about 4 μm in major dimension;

c) a plurality of sulfides uniformly distributed throughout the ferritic matrix, said sulfides being not greater than about 2 μm in major dimension; and d) the microstructure is substantially free of lamellar carbides and carbide networks.

2. The method as claimed in claim 1 comprising the step of cold drawing the elongated intermediate article after said heat treating step to reduce the cross-sectional area of said elongated intermediate article to provide an elongated article having a small cross section for precision machining of parts.

3. The method as claimed in claim 1 wherein the hot working step comprises hot rolling the intermediate article to reduce the cross-sectional area of the intermediate article before said heat treating step.

4. The method as claimed in claim 1 wherein in the step of atomizing the steel alloy comprises the step of atomizing the alloy with nitrogen gas.

5. The method as claimed in claim 1 wherein the step of consolidating the steel powder comprises hot isostatic pressing of the steel powder.

6. The method as claimed in claim 1 wherein the steel alloy has the following weight percent composition:

| | |
|---|---|
| C | 0.92-0.98 |
| Mn | 0.20-0.80 |
| Si | 0.12-0.22 |
| P | 0.030 max. |
| S | 0.010-0.090 |
| Cr | 0.30-0.60 |
| Ni | 0.10-0.25 |
| Mo | 0.25 max. |
| Cu | 0.10-0.23 |
| V | 0.035-0.060 |
| N | 0.060 max. |
| O | 0.040 max. |

and the balance is iron and usual impurities.

7. A small diameter elongated steel article, consisting essentially of fully consolidated, prealloyed metal powder formed from a steel alloy having the following weight percent composition in a melting furnace:

| | |
|---|---|
| C | 0.88-1.00 |
| Mn | 0.20-0.80 |
| Si | 0.12-0.22 |
| P | 0.050 max. |
| S | 0.010-0.100 |
| Cr | 0.30-0.90 |
| Ni | 0.10-0.50 |
| Mo | 0.25 max. |
| Cu | 0.08-0.23 |
| V | 0.025-0.15 |
| N | 0.060 max. |
| O | 0.040 max. |

the balance being iron and usual impurities;

wherein the consolidated metal powder has a microstructure consisting essentially of:

a) a ferritic matrix having a substantially uniform distribution of fine grains characterized by a grain size number of at least about 8 as determined in accordance with ASTM Standard Specification E 112;

b) a plurality of fine carbides uniformly distributed throughout the ferritic matrix, said carbides being substantially spheroidal in shape and not greater than about 4 μm in major dimension;

c) a plurality of sulfides uniformly distributed throughout the ferritic matrix, said sulfides being not greater than about 2 μm in major dimension; and d) the microstructure is substantially free of lamellar carbides and carbide networks.

8. The steel article as claimed in claim 7 wherein the article comprises wire having a diameter of up to 15 mm.

9. The steel article as claimed in claim 8 wherein the article comprises wire having a diameter of up to 6.5 mm.

10. The steel article as claimed in claim 7 wherein the steel alloy has the following weight percent composition:

| | |
|---|---|
| C | 0.92-0.98 |
| Mn | 0.20-0.80 |
| Si | 0.12-0.22 |
| P | 0.030 max. |
| S | 0.010-0.090 |
| Cr | 0.30-0.60 |
| Ni | 0.10-0.25 |
| Mo | 0.25 max. |
| Cu | 0.10-0.23 |
| V | 0.035-0.060 |
| N | 0.060 max. |
| O | 0.040 max. |

and the balance is iron and usual impurities.

11. The steel article as claimed in claim 7 wherein vanadium is about 0.025% to about 0.060%.

* * * * *